US010141125B2

(12) United States Patent
Garcia

(10) Patent No.: US 10,141,125 B2
(45) Date of Patent: Nov. 27, 2018

(54) CONTACT FOR BUS PLUG SWITCHES

(71) Applicant: Garrett Garcia, Vista, CA (US)

(72) Inventor: Garrett Garcia, Vista, CA (US)

( * ) Notice: Subject to any disclaimer, the term of this patent is extended or adjusted under 35 U.S.C. 154(b) by 459 days.

(21) Appl. No.: 14/685,336

(22) Filed: Apr. 13, 2015

(65) Prior Publication Data

US 2016/0300683 A1 Oct. 13, 2016

(51) Int. Cl.

| | |
|---|---|
| ***H01H 1/32*** | (2006.01) |
| ***H01H 85/02*** | (2006.01) |
| ***H01H 89/00*** | (2006.01) |
| *H01H 71/52* | (2006.01) |
| *H01H 1/22* | (2006.01) |
| *H01H 9/38* | (2006.01) |

(52) U.S. Cl.

CPC ..... *H01H 1/32* (2013.01); *H01H 85/0241* (2013.01); *H01H 89/00* (2013.01); *H01H 1/22* (2013.01); *H01H 1/226* (2013.01); *H01H 9/383* (2013.01); *H01H 9/386* (2013.01); *H01H 71/52* (2013.01)

(58) Field of Classification Search

CPC ..... H01H 1/22; H01H 1/221; H01H 1/225; H01H 1/32; H01H 2001/223; H01H 71/52; H01H 85/0241; H01H 89/00; H01H 1/22632; H01H 9/383; H01H 9/386

USPC ..... 337/110

See application file for complete search history.

(56) References Cited

U.S. PATENT DOCUMENTS

| | | | | | |
|---|---|---|---|---|---|
| 677,340 | A | | 7/1901 | Cowperthwait | |
| 736,447 | A | | 8/1903 | Scott | |
| 854,790 | A | | 5/1907 | Aalborg | |
| 1,693,631 | A | * | 12/1928 | Williams | H01H 1/221 200/275 |
| 3,028,460 | A | * | 4/1962 | Turton | H02G 5/08 200/281 |
| 3,198,898 | A | * | 8/1965 | Piteo, Jr. | H01H 71/1018 200/338 |
| 3,354,352 | A | | 11/1967 | Goodridge | |
| 4,713,504 | A | | 12/1987 | Maier | |
| 4,912,599 | A | | 3/1990 | Wittmer | |
| 6,018,284 | A | * | 1/2000 | Rival | H01H 77/101 218/154 |
| 6,417,474 | B1 | * | 7/2002 | Rakus | H01H 9/46 218/148 |
| 6,507,256 | B1 | * | 1/2003 | Castonguay | H01H 71/2472 218/22 |
| 7,202,427 | B2 | | 4/2007 | Bach | |
| 7,217,895 | B1 | * | 5/2007 | Shea | H01H 1/22 200/244 |
| 2003/0001701 | A1 | * | 1/2003 | Bach | H01H 1/226 335/9 |
| 2005/0000785 | A1 | * | 1/2005 | Brescian | H01H 77/104 200/244 |

* cited by examiner

*Primary Examiner* — Jacob R Crum

(74) *Attorney, Agent, or Firm* — Lyman Smith; Patent Service Associates

(57) ABSTRACT

The present invention improves bug plug technology by providing a rotatable contact head to align contact surfaces in parallel. The parallel alignment avoids pitting of the surfaces by eliminating sparking gaps, improves the surface area-in-contact, and lengthens the useful life of the contact components. The novel features include minimizing heel-toe incursion during contact.

9 Claims, 5 Drawing Sheets

CONTACT FOR BUS PLUG SWITCHES

FIELD OF THE INVENTION

This invention relates to electrical switches for industrial use, and more particularly to bus plug switches.

BACKGROUND OF THE INVENTION

Bus bars are used for very high currents in electrical apparatuses, and for high currents distributed throughout a building. A bus bar is a live conductor comprised of a rigid piece of copper or aluminum, usually in flat bars. For industrial applications involving electrical chases, several bus bars are pre-assembled, with or without insulators, in grounded enclosures called busways. The set of bus bars in a busway represent the phases of the chosen electrical system, much the same as insulated electrical cabling.

A particular busway, known as a "plug-in bus", is used to distribute power down the length of a building. It is constructed to allow tap-out switches to be installed at designed places along the bus. The advantage with this scheme is the ability to remove or add a branch circuit without removing voltage from the whole circuit. An additional advantage is to protect any tapped-in electrical equipment from faults in the circuit.

Bus plugs connect to the busway to provide localized distribution to electrical appliances or devices. Circuit protection for bus plugs may be in the form of a circuit breaker or a fuse. Bus plugs often include a disconnect switch to rapidly interrupt and disconnect current flowing through an electrical device in the event of an emergency. So-called "tap boxes" are the enclosures that connect power cables feeds to a busway. A "plug-in tap box" connects to a busway with a bus plug. Bus plug sizes are graded by voltage and ampere ratings. Voltage ratings commonly range from 120/40, 208-120, 240, 277/480, 480, and 600 in the U.S. The most common bus plug ampere ratings in the U.S. are 30 amps and 60 amps, although these ratings can go as high as 600 amps.

Bus plugs are required to run under high current load for long periods of time and are often cycled on and off. Stress-of-use, under such circumstances, require the internal components and design to be robust. Component failure is limiting in the present state of art, requiring costly refurbishment or replacement. One of the components that has shown excessive wear is the electrical contacts which engage and disengage power to the equipment.

Contact design involves several elements. The material composition is critical for conductivity, as well as heating, properties. Regarding the latter, dissipating heat is one aspect while avoiding spot-welding at touch-points is another. The contact size is critical to the amount of power to be transferred through the contact surfaces, the larger surface areas-in-contact affording greater current flow. The mating force of, or, otherwise, pressure on, the contact surfaces is also critical. From a microscopic perspective, the surfaces are not flat but peaks and valleys in an undulating terrain. Pressure, often in the form of springs, forces the peaks into the valleys to increase the contact surface area.

The last design element is parallelism of the contact surfaces. Serving this element of design is what is missing in the prior art. Parallelism affects both the amount of surface area in contact, as well as a phenomenon known as "pitting". Pitting is corrosion caused by an arcing discharge between electrodes. When two surfaces are brought together by pivoting one of the surfaces onto the other, such as is typical in the art, it is inevitable that the mating will occur through progressively narrowing angles where one portion of the surfaces will touch before another and where some angular mal-adjustment of the planes of the surfaces will remain. The gaps caused by the angular disparity of fixed contact "heads", reduces the effective surface area while setting up, by graduated inclination, a critical distance for arcing discharge. It has been shown that up to 75% of physical contact area can lost in non-parallel contacts, notwithstanding additional loss due to corrosive effects.

The instant invention addresses this unfulfilled need in the art field of bus plugs.

SUMMARY OF THE INVENTION

It is accordingly an object of the present invention to provide a mechanism to bring the bus plug switch contacting surfaces together in parallel alignment. It is a further object to make the mechanism self-aligning and thereby avoid ancillary adjustment mechanisms. It is a further object to avoid a "heel-toe", or a rocking, type of engagement in making contact between electrified surfaces. It is a further object, in the pursuit of parallel contact, to maximize surface area-in-contact and to avoid pitting of the engaged surfaces. It is a further object, in outcome of the above, to provide lifetime longevity to bus plug equipment.

These objects, and others to become hereinafter apparent, are embodied in a single-pole electrical switch for a bus plug, comprising, in a first element, a stationary contact having a first contact surface. A second element comprises a moveable contact having a second contact surface, the moveable contact mounted to a contact head pivotally-mounted to a rotating contact arm about a pivot axis. The pivot axis lies in a bisecting plane to the contact head. The moveable contact is rotationally moveable between an open position and a closed position. The closed position brings the first and second contact surfaces into mutual contact and completes, thereby, an electrical circuit. Lastly, a third element comprises a switching means to move the contacts between the open position and the closed position. In the above configuration, when the switching means moves the movable contact into the closed position, the contact surfaces are aligned by articulation of the pivotally-mounted second contact, and pitting of the contact surfaces by electric current flowing there through is prevented by intimate engagement of the contact surfaces.

In the preferred embodiment, a multiplicity of the single-pole electrical switches, as described above, are ganged together in a singular switching means and installed in a plug-in housing. The ganged switches are electrically connected to an input port in the plug-in housing and similarly connected, though fuses, to an output port. In a particular preferred embodiment, the switching means is a lever mechanism.

In an alternate embodiment, a means for making a bus plug comprises, in a first step, providing, for each pole of a preferred electrical circuit, a single-pole switch comprising a stationary contact having a first contact surface and a moveable contact having a second contact surface; wherein, the moveable contact is moveable by means of a rotating contact arm between an open position and a closed position. The closed position brings the first and second contact surfaces into mutual contact and completes, thereby, an electrical circuit. A second step comprises pivotally mounting the contact head to the rotating contact arm about a pivot axis, the pivot axis lying in a bisecting plane to the contact head. A third step comprises ganging each single-pole switch together by a switching means to move the contacts in unison between the open position and the closed position. A fourth step comprises mounting the ganged switch inside a plug-in housing having an input port and an output port. A fifth step comprises connecting each switch electrically to a corresponding pole in the input port. Finally, a sixth step comprises connecting each switch electrically through a fuse to a corresponding pole in the output port. In the resulting configuration, when the switching means moves the movable contact into the closed position, the contact surfaces are aligned by articulation of the pivotally-mounted second contact, and pitting of the contact surfaces by electric current flowing there through is prevented by intimate engagement there between.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION OF THE PREFERRED EMBODIMENT

Throughout the description and the claims, the term "bus plug" will be taken to refer to any and all components mounted in a plug-in housing, including, but not limited to, a switch assembly, fuses, and all electrical wiring and connections. The compound term "bus lug switch" will be used interchangeably with "ganged switch" when referring to multiple poles.

Figure 1:
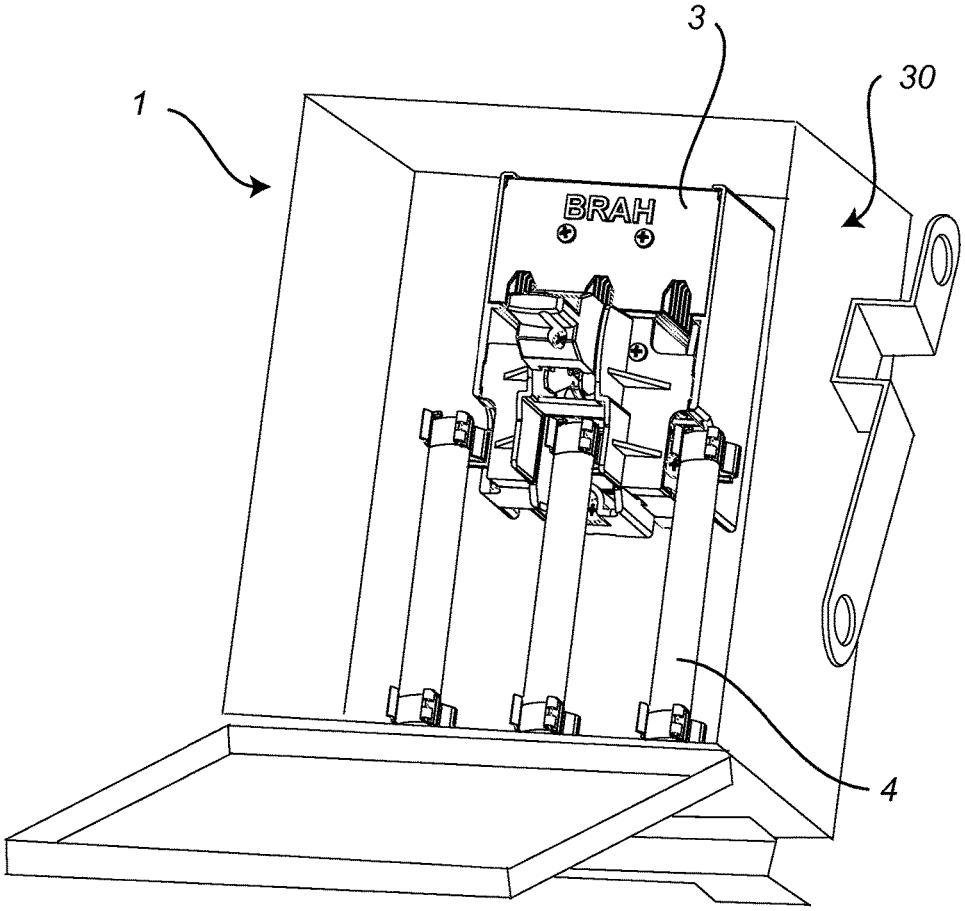
FIG. 1 is a perspective view of a bus plug in a plug-in housing.
Figure 2:
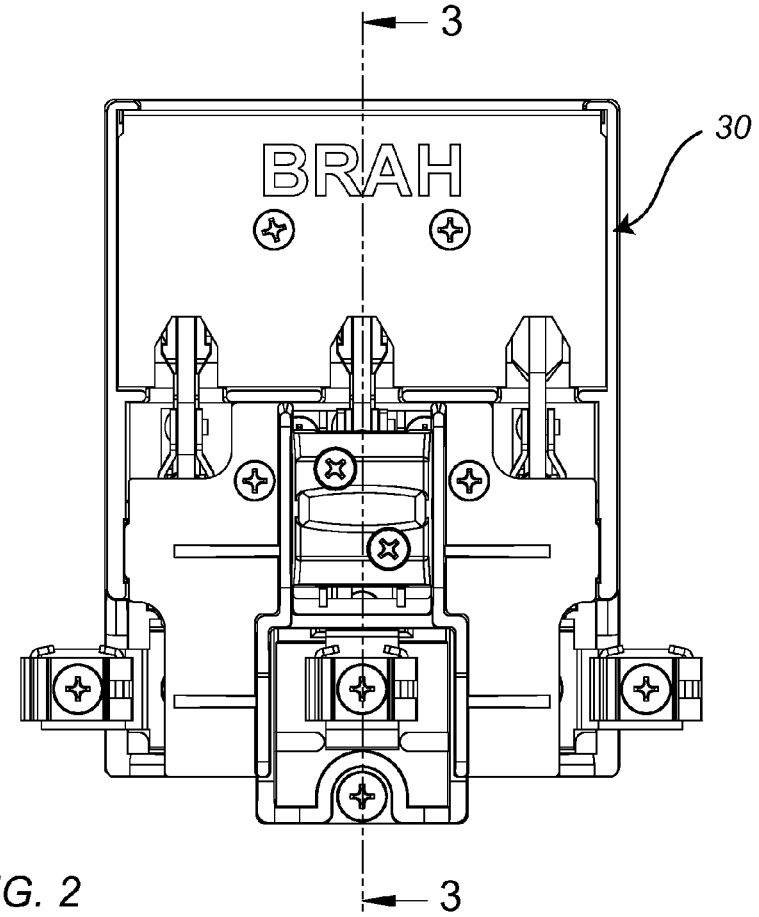
FIG. 2 is a front elevation view of a bus plug.
Figure 3:
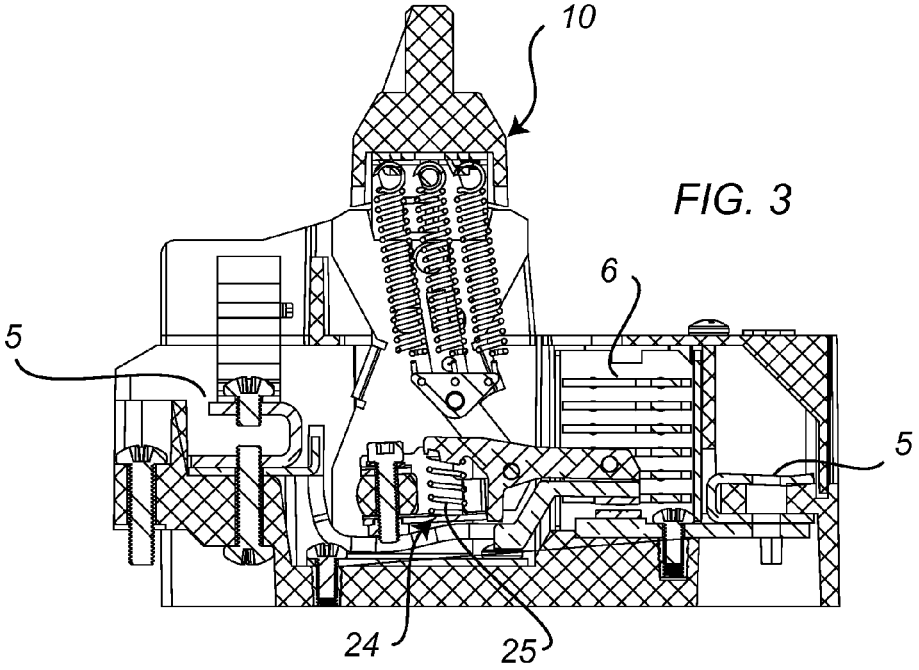
FIG. 3 is a rotated section view taken along the lines 3-3 of FIG. 2.
Figure 4:
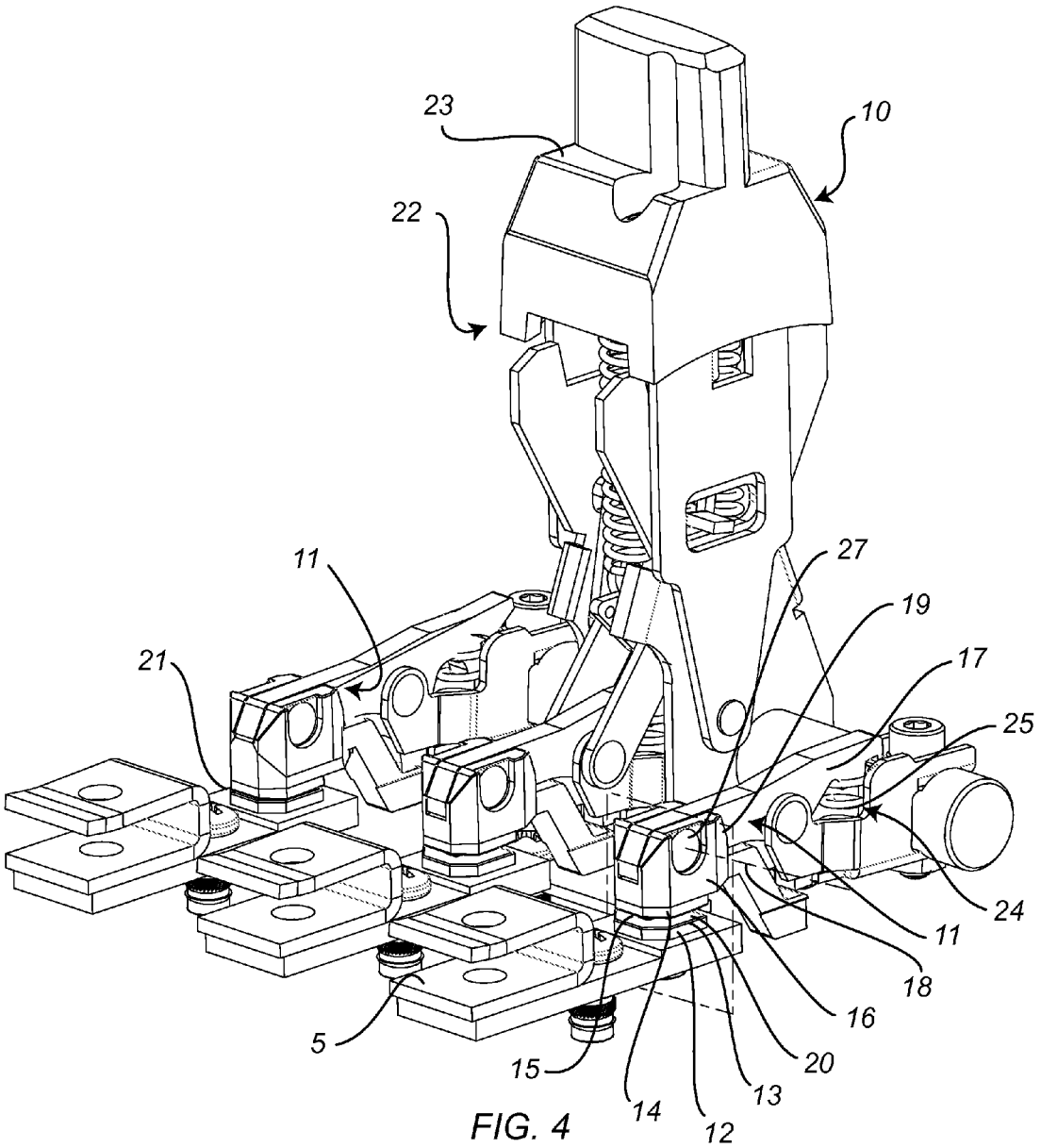
FIG. 4 is a perspective view of a bus plug switch.

Referring to FIG. 1, a bus plug assembly is comprised of a switch assembly 3, one or more fuses 4 and a plug-in housing 30. Referring to FIGS. 2-4, the switch assembly 3 is comprised of a bus plug switch 10, two or more terminals 5 for wire connections, and a heat-dissipation structure 6. The bus plug switch 10 is comprised of one or more single pole switches 11 each operated from an open position 20 to a closed position 21, whereat an electrical current circuit flowing through the switch is broken, by a switching means 22. In the case of multiple poles, the single pole switches 11 are "ganged" together by the switching means 22 so that all poles, and associated electrical circuits through them, are engaged or broken at the same time. In the preferred embodiment, the switching means 22 is a lever mechanism 23. The preferred circuit configuration is defined by the number of poles representing select phases of AC current.

Figure 6:
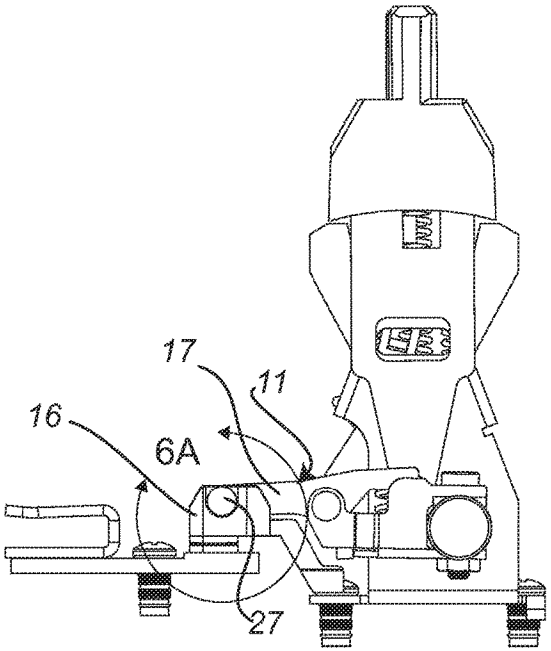
FIG. 6 is a left-side elevation view of a bus plug switch with the innovative moveable contact of the present invention illustrating the alignment of the contact surfaces.
Figure 6A:
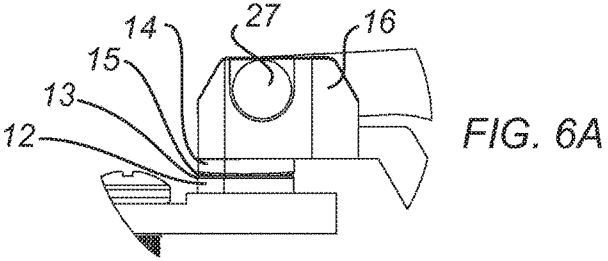
FIG. 6A is a detail view taken at 6A of FIG. 6 showing a close up of the aligned surfaces.
Figure 5:
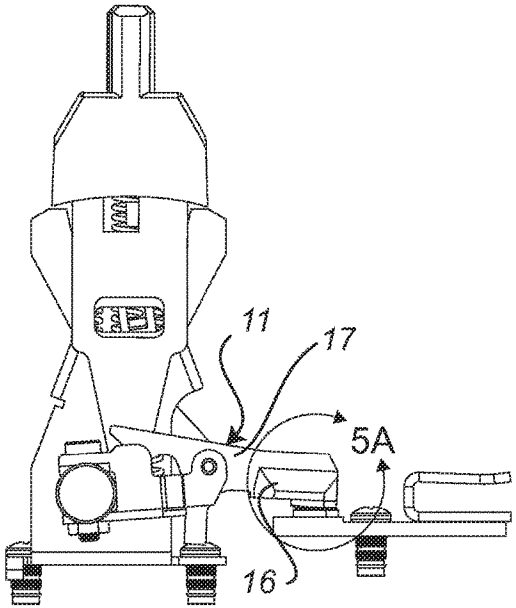
FIG. 5 (Prior Art)
FIG. 5 is a right-side elevation view of a bus plug switch with stationary contacts illustrating a mismatch of contact surfaces.
Figure 5A:
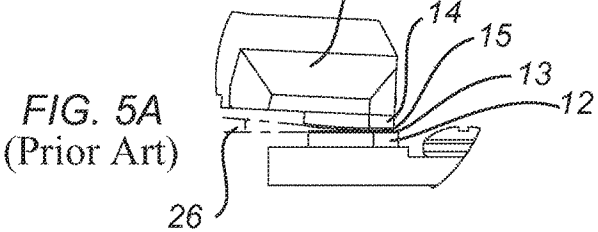
FIG. 5A (Prior Art)
FIG. 5A is a detail view taken at 5A of FIG. 5 showing a close up of the mismatch.

Referring to FIGS. 4-6, the single pole switch 11 is comprised of a stationary contact 12, having a first contact surface 13, and a moveable contact 14, having a second contact surface 15. The moveable contact 14 is fixed to a contact head 16, which is pivotally connected about a pivot axis 18 to a contact arm 17. The contact arm 17 pivots on a secondary axis to move the contacts between the open position 20 and the closed position 21. In the prior art case (FIG. 5A), where the contact head 16 is fixed with respect to the contact arm 17, the squaring alignment of the contact surfaces becomes subject to the smallest of relative vertical displacements of the contacts, which gives rise to a malalignment measured in a disparity angle 26. The disparity angle 26 opens a gap in which arcing may occur. The consequential arcing, over time, leads to pitting, reduced effective contact area and ultimate compromise of the contacts. By contrast, in the case of the instant invention, wherein the novel pivoting head is capable of self-alignment, the contact surfaces are in parallel disposition with the disparity angle 26 at zero (FIG. 6A).

The pivot axis 18 is preferably located in a bisecting plane 19, which substantially bisects the contact head 16. The location minimizes any heel-toe wobble of the contact head 16, by means of its medial positioning, when brought into the closed position 21. The contact head 16 is rotationally mounted to the contact arm 17 through a coaxial rivet 27. The rotational friction about coaxial rivet 27, in the sense of "looseness" of a joint so formed, is preferably such that the contact head 16 self-aligns under force of a biasing means 24 applied to contact arm 17. The rotational friction, also, in the sense of "tightness" of the joint, is preferably such that the relative position of the contact head 16 on the contact arm 17 is held when the contacts are separated. In this manner, flush contact is immediately made when the surfaces are rejoined and arcing potential is thereby suppressed in iterative instances. The biasing means 24 applies pressure to the mating contact surfaces in the closed position 21 and facilitates intimacy of the contact. In the preferred embodiment, the biasing means is spring 25 (FIGS. 3, 4).

The preferred material composition for the first contact surface 13 and the second contact surface 15 is silver at 90%-95% assay. Alloying metals comprise cadmium, tungsten and nickel.

Figure 7:
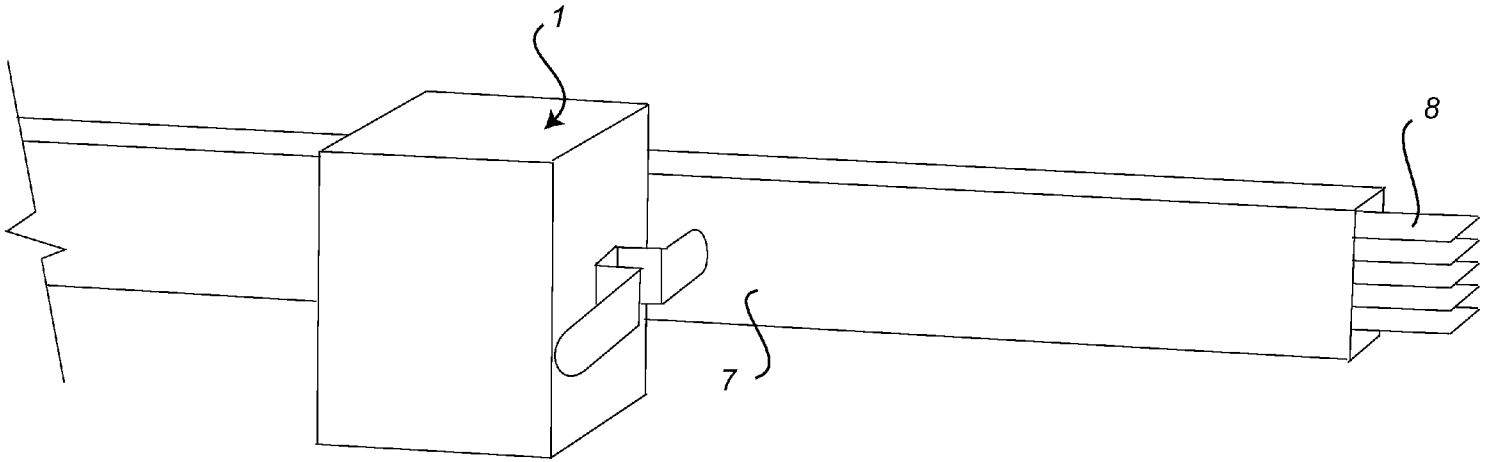
FIG. 7 is a perspective schematic showing a bus plug in a plug-in housing mounted on a bus way with exposed bus bars.
Figure 8:
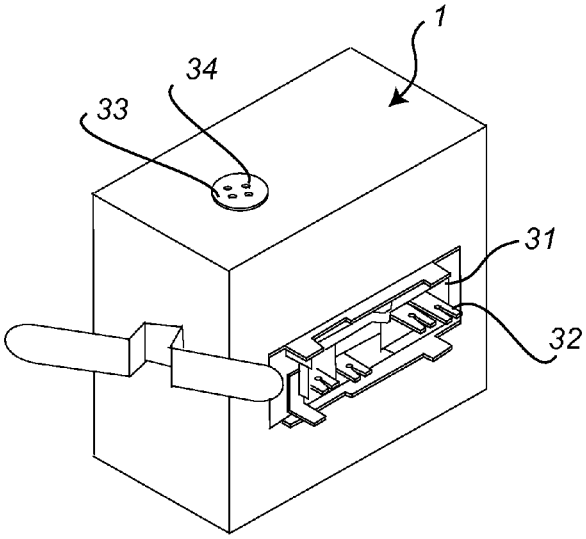
FIG. 8 is a perspective schematic showing input and output ports of a plug-in housing.

Referring to FIGS. 7 and 8, the bus plug assembly 1, in use, is physically connected to busway 7 and electrically connected, pole by pole, to bus bars 8. The electrical connections flow through input port 31 through individual input poles 32. Inside the bus plug assembly 1, electrical communication from each input pole 32 to a corresponding pole of the bus plug 2 is made by electrical wiring (not shown), or, otherwise, by internal busses (not shown). From the bus plug 2, electrical communication continues, through a corresponding fuse 4, to a corresponding output pole 34 in an output port 33. The output port 33 serves a line tap to satellite electrical equipment.

In an alternate embodiment, a method of making a bus plug 2 comprises the steps of:

(i.) providing, for each pole of a preferred electrical circuit, a single pole switch 11 comprising a stationary contact 12 having a first contact surface 13; a moveable contact 14 having a second contact surface 15, the moveable contact 14 rotatably moveable by means of a rotating contact arm 17 between an open position 20 and a closed position 21, the closed position 21 bringing the first and second contact surfaces into mutual contact and completing thereby an electrical circuit;

(ii.) mounting, pivotally, the contact head 16 to the rotating contact arm 17 about a pivot axis 18, the pivot axis 18 in a bisecting plane 19 to the contact head 16;

(iii.) ganging each single pole switch 11 together in a switching means 22 to move the contacts in unison between the open position 20 and the closed position 21;

(iv.) mounting the ganged switch inside a plug-in housing 30 having an input port 31 and an output port 33;

(v.) connecting each single-pole switch 11 electrically to a corresponding pole 32 in the input port 31; and (vi.) connecting each single-pole switch 11 electrically through a fuse 4 to a corresponding pole 34 in the output port 33;

(vii.) whereby, when the switching means 22 moves the movable contact 14 into the closed position 21, the contact surfaces are aligned by articulation of the pivotally-mounted second contact surface 15, and pitting of the contact surfaces by electric current flowing there through is prevented by intimate engagement.

It is to be understood that the invention is not limited in its application to the details of construction and to the arrangements of the components set forth in the preceding description or illustrated in the drawings. For example, the switching means 22 might include a trip switch. Also, it is to be understood that the phraseology and terminology employed herein are for the purpose of the description and should not be regarded as limiting.

What is claimed is:

1. A single-pole electrical switch for a bus plug, comprising:

a stationary contact having a first contact surface;

a moveable contact having a second contact surface, the moveable contact mounted to a contact head pivotally-mounted to a rotating contact arm about a pivot axis, the moveable contact rotatably moveable between an open position and a closed position, the closed position bringing the first and second contact surfaces into mutual contact and completing thereby an electrical circuit, wherein in the closed position the pivot axis is entirely in a plane bisecting the second contact surface at a right angle;

a switching means to move the contacts between the open position and the closed position;

whereby, when the switching means moves the movable contact into the closed position, the contact surfaces are aligned by articulation of the pivotally-mounted second contact, and pitting of the contact surfaces by electric current flowing there through is prevented by intimate engagement.

2. The single-pole electrical switch of claim 1, wherein the switching means is a lever mechanism.

3. The single-pole electrical switch of claim 1, further comprising a biasing means to force the first and second contact surfaces into intimate contact in the closed position.

4. The single-pole electrical switch of claim 3, wherein the biasing means is a spring operating against the rotating arm.

5. A bus plug having at least two poles, comprising:

a plug-in housing having an input port and an output port;

at least two single-pole electrical switches according to claim 1 contained within the housing, the at least two single-pole electrical switches ganged to a common switching means for unitary deployment, each electrical switch in electrical communication to a corresponding pole in the input port; and at least two fuses, each fuse in electrical communication between a corresponding electrical switch and a corresponding pole in the output port.

6. A method of making a bus plug, comprising the steps:

providing, for each pole of an electrical circuit, a single pole switch comprising a stationary contact having a first contact surface; a moveable contact having a second contact surface, the moveable contact rotatably moveable by means of a rotating contact arm between an open position and a closed position, the closed position bringing the first and second contact surfaces into mutual contact and completing thereby an electrical circuit;

mounting pivotally the contact head to the rotating contact arm about a pivot axis wherein in the closed position the pivot axis is entirely in a plane bisecting the second contact surface at a right angle;

ganging each single pole switch together by a switching means to move the contacts in unison between the open position and the closed position;

mounting the ganged switch inside a plug-in housing having an input port and an output port;

connecting each single-pole switch electrically to a corresponding pole in the input port; and connecting each single-pole switch electrically through a fuse to a corresponding pole in the output port;

whereby, when the switching means moves the movable contact into the closed position, the contact surfaces are aligned by articulation of the pivotally-mounted second contact, and pitting of the contact surfaces by electric current flowing there through is prevented by intimate engagement.

7. The method of claim 6, wherein the switching means is a lever mechanism.

8. The method claim 6, further comprising a biasing means to force the first and second contact surfaces into intimate contact in the closed position.

9. The method of claim 8, wherein the biasing means is a spring operating against the rotating arm.

* * * * *